US011435771B2

(12) United States Patent
Sankman et al.

(10) Patent No.: US 11,435,771 B2
(45) Date of Patent: Sep. 6, 2022

(54) LOW DROPOUT REGULATOR (LDO) CIRCUIT WITH SMOOTH PASS TRANSISTOR PARTITIONING

(71) Applicant: TEXAS INSTRUMENTS INCORPORATED, Dallas, TX (US)

(72) Inventors: Joseph Alan Sankman, Dallas, TX (US); Raveesh Magod Ramakrishna, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 160 days.

(21) Appl. No.: 16/810,108

(22) Filed: Mar. 5, 2020

(65) Prior Publication Data

US 2020/0285261 A1 Sep. 10, 2020

Related U.S. Application Data

(60) Provisional application No. 62/814,137, filed on Mar. 5, 2019.

(51) Int. Cl.
*G05F 1/575* (2006.01)
*G05F 1/59* (2006.01)

(52) U.S. Cl.
CPC ..... *G05F 1/59* (2013.01); *G05F 1/575* (2013.01)

(58) Field of Classification Search
CPC . G05F 1/59; G05F 1/575; G05F 1/565; G05F 1/46; G05F 1/561; G05F 1/563; G05F 1/461; G05F 1/467; G05F 1/56; H02M 1/0045; H02M 1/0003
See application file for complete search history.

(56) References Cited

U.S. PATENT DOCUMENTS

| | | | | |
|---|---|---|---|---|
| 7,723,968 | B2 * | 5/2010 | Okuyama | G05F 1/575 323/274 |
| 9,766,642 | B2 * | 9/2017 | Pons | G05F 1/575 |
| 9,917,513 | B1 * | 3/2018 | Le | H02M 3/156 |
| 10,571,945 | B2 * | 2/2020 | Pishdad | G06F 1/3203 |
| 2010/0052635 | A1 * | 3/2010 | Wang | G05F 1/575 323/280 |
| 2011/0156671 | A1 * | 6/2011 | Gakhar | G05F 1/563 323/280 |
| 2017/0212540 | A1 * | 7/2017 | Cho | G05F 1/56 |

* cited by examiner

*Primary Examiner* — Thienvu V Tran
*Assistant Examiner* — Shahzeb K Ahmad
(74) *Attorney, Agent, or Firm* — Mark A. Valetti; Charles A. Brill; Frank D. Cimino

(57) ABSTRACT

A system includes a battery. The system also includes a low dropout regulator (LDO) circuit with an input coupled to the battery and the LDO circuit. The system also includes a load coupled to an output of the LDO circuit. The LDO circuit includes an error amplifier and a control circuit coupled to the error amplifier. The LDO circuit also includes a first pass transistor coupled to the control circuit and configured to provide a first pass current as a function of load current according to a first continuous conduction curve. The LDO circuit also includes a second pass transistor coupled to the control circuit and configured to provide a second pass current as a function of load current according to a second continuous conduction curve.

20 Claims, 6 Drawing Sheets

LOW DROPOUT REGULATOR (LDO) CIRCUIT WITH SMOOTH PASS TRANSISTOR PARTITIONING

CROSS-REFERENCE TO RELATED APPLICATIONS

This application claims priority to U.S. Provisional Application No. 62/814,137, filed Mar. 5, 2019, which is hereby incorporated by reference.

BACKGROUND

In order to extend the battery life of batteries in modern electronic devices (such as cell phones, Internet of Things (IoT) devices, wearable devices and e-cigarettes), low dropout linear regulators (LDO) with low quiescent current (Iq) are preferred by electronic manufacturers. An example LDO has pass field-effect transistor (FET) with current terminals coupled between an input node and an output node, and with a control terminal coupled to an error amplifier output. In operation, the output voltage ($V_{OUT}$) at the output node of an LDO is a function of the input voltage ($V_{IN}$) at the input node, the operations of the error amplifier, and the characteristics of the pass FET.

In order to reduce the Iq of an LDO, the error amplifier can be biased with a low current. For example, the error amplifier may be biased on the order of 1 to 10 nA. This low biasing can create several problems, such as degraded transient response (undershoot and settling) of the LDO, stability issues and thermal noise. With regard to transient response, a tail current bias (the bias current of the first stage of the error amplifier) of 1-10 nA results in an extremely low frequency pole at the output of the first stage of the error amplifier. This means the light-to-heavy load current transient response of a respective LDO can be slow (on the order of milliseconds), with significant undershoot (potential $V_{OUT}$ collapse to ground). The effect of low biasing of the error amplifier on the LDO's transient response is relevant for different types of pass FETs (e.g., NMOS or PMOS transistors).

In addition to causing slow transient response of the LDO, the stability of the error amplifier, at such low bias currents, is challenging due to the extremely low frequency internal pole. As an example, the output impedance of the first stage of the error amplifier can be on the order of tens of Giga Ohms for 1-10 nA biasing, meaning the error amplifier pole location can be ~1 Hz (assuming 10-20 pF compensation capacitor). At close to no load, this is a severe problem when the output pole (formed by the load impedance and output capacitor at the output node of the LDO) overlaps with the internal pole location. In this scenario, the LDO will be unstable unless a zero is inserted near the unity gain crossover frequency (on the order of 100s of Hz). To ensure stability across load currents, a pole-zero ladder is needed in conventional solutions. See e.g., U.S. Pat. No. 8,115,463. This involves compensation zero resistors on the order of 100 MΩ to 1 GΩ, which is impractical to achieve in an area-constrained design. Moreover, increasing the compensation capacitor size to reduce resistor area degrades transient response time as the slewing time of the compensation is increased. Also, when biasing the error amplifier at 1-10 nA, the gate pole of the pass FET can impinge on the bandwidth of the LDO at light load, causing instability as there are three poles within the bandwidth and only one zero (or pole-zero ladder).

SUMMARY

In accordance with at least one example of the disclosure, a system comprises a battery. The system also includes a low dropout regulator (LDO) circuit with an input coupled to the battery or a switching converter between the battery and the LDO circuit. The system also comprises a load coupled to an output of the LDO circuit. The LDO circuit comprises an error amplifier and a control circuit coupled to the error amplifier. The LDO circuit also comprises a first pass transistor coupled to the control circuit and configured to provide a first pass current as a function of load current according to a first continuous conduction curve. The LDO circuit also comprises a second pass transistor coupled to the control circuit and configured to provide a second pass current as a function of load current according to a second continuous conduction curve.

In accordance with at least one example of the disclosure, a low dropout regulator (LDO) integrated circuit (IC) comprises an error amplifier and a control circuit coupled to the error amplifier. The LDO IC also comprises a first pass transistor coupled to the control circuit and configured to provide a first pass current as a function of load current according to a first continuous conduction curve. The LDO IC also comprises a second pass transistor coupled to the control circuit and configured to provide a second pass current as a function of load current according to a second continuous conduction curve.

In accordance with at least one example of the disclosure, an LDO circuit includes a voltage supply node, an output node, and an error amplifier coupled to the voltage supply node and the output node, wherein the error amplifier includes a first stage. The LDO circuit also includes a control circuit with a first current path coupled to an output of the first stage, and with a second current path coupled to an first current path via a current mirror. The LDO circuit also includes a first pass transistor with a first current terminal coupled to the voltage supply node, with a second current terminal coupled to the output node, and with a control terminal coupled to the second current path. The LDO circuit also includes a second pass transistor with a first current terminal coupled to the voltage supply node, with a second current terminal coupled to the output node; and with a control terminal coupled to the first current path.

BRIEF DESCRIPTION OF THE DRAWINGS

For a detailed description of various examples, reference will now be made to the accompanying drawings in which.

DETAILED DESCRIPTION

Disclosed herein is a low dropout regulator (LDO) circuit topology with an error amplifier, split pass transistors, and a control circuit that provides smooth pass current transitions as a function of load current. In the proposed LDO circuit topology, the quiescent current (Iq) meets target values (e.g., 25 nA for the entire LDO) in a no load scenario. Once the load current begins to increase, different pass transistors of the proposed LDO circuit topology begin to conduct current in a smooth and multi-staged manner. In one example, an LDO circuit topology includes a first pass transistor, a second pass transistor, and a third pass transistor, where first, second, and third pass transistors have different sizes. The relative sizes of the first, second, and third pass transistors depends on LDO design factors, such as the target output voltage and target load current range. Also, the gate drive signals for the first, second, and third pass transistors are controlled according to respective first, second, and third continuous conduction curves. In some examples, the smallest pass transistor (e.g., the third pass transistor) begins to conduct first from a no load state according to a third continuous conduction curve, the next smallest pass transistor (e.g., the second pass transistor) begins to conduct next from a no load state according to a second continuous conduction curve, and the largest pass transistor (e.g., the first pass transistor) begins to conduct last from a no load state according to a first continuous conduction curve.

In some examples, the proposed LDO circuit topology includes an error amplifier along with pass metal-oxide semiconductor field-effect transistor (MOSFET) partitioning at the output of the error amplifier to reduce quiescent current (Iq) in a no load state. With a reduced Iq, the proposed LDO circuit topology enables a battery-powered system that includes the LDO circuit to have a longer lifetime. To provide a better understanding, various LDO circuit options and related systems or scenarios are described using the figures as follows.

Figure 1A:
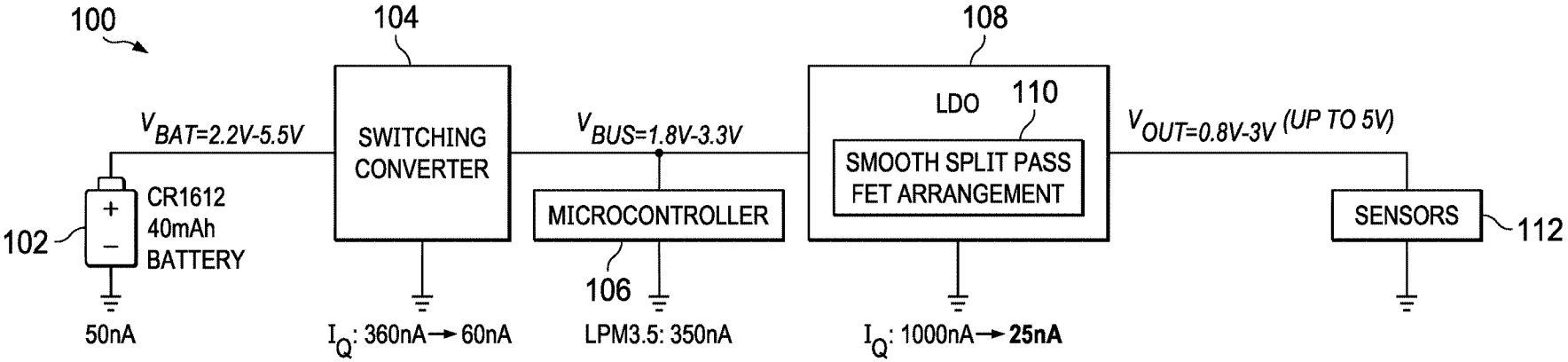
FIG. 1A is a block diagram of a system in accordance with an example embodiment.

FIG. 1A is a block diagram of a battery-operated electronics system 100 in accordance with an example embodiment. As shown, the system 100 includes a battery 102 coupled to a switching converter 104 and configured to provide an input voltage (e.g., 2.2V-5.5V) to the switching converter 104. In some examples, the battery 102 corresponds to a CR1612 40 mAh battery. The output of the switching converter 104 is a bus voltage (e.g., 1.8V-3.3V) provided to a microcontroller 106 and an LDO circuit 108. In some examples, the microcontroller 106 is configured to send information to and/or receive information from a load 112 (e.g., sensors) via an output (e.g., 0.8V-3.3V) of the LDO circuit 108. In the example of FIG. 1, the LDO circuit 108 includes a smooth spit pass FET arrangement 110 of an example embodiment, which reduces the Iq compared to other LDO circuit topologies (represented in FIG. 1A as a reduction from 1000 nA to 25 nA). With the reduced Iq, for the LDO circuit 108 and/or other improvements (e.g., reduced Iq of the switching converter 104 and/or reduced power consumption of the microcontroller 106), the lifetime of the battery 102 with the system 100 is extended from approximately 2.7 years to approximately 7.4 years.

Figure 1B:
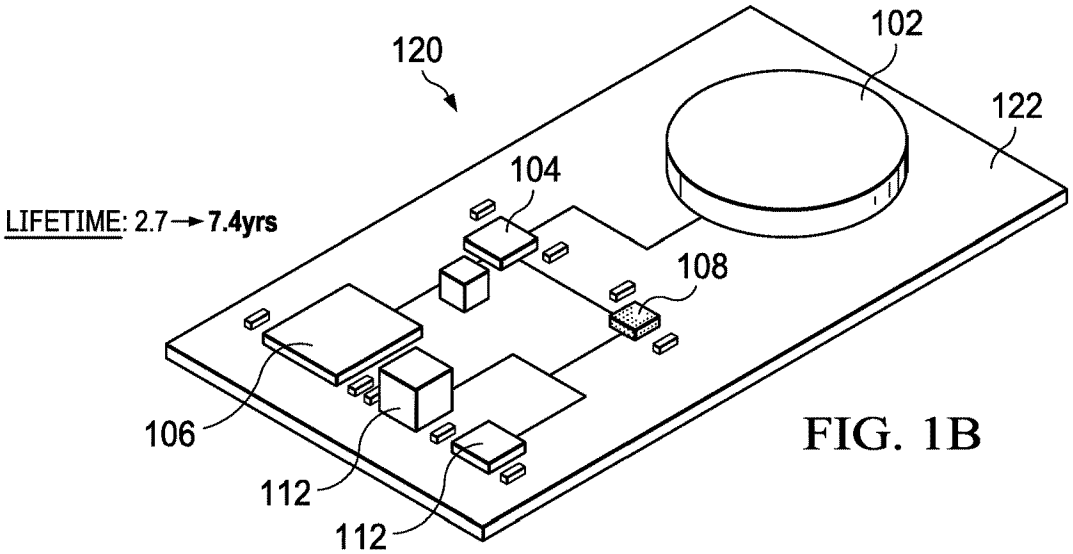
FIG. 1B is a perspective view of a circuit with the system components of FIG. 1A in accordance with an example embodiment.

FIG. 1B is a perspective view of a circuit 120 with the system components of FIG. 1A in accordance with an example embodiment. In FIG. 1B, the circuit 120 includes a printed circuit board (PCB) 122 with the battery 102, the switching converter 104, the microcontroller 106, the LDO circuit 108, and the load 112 mounted to the PCB 122. In some examples, the circuit 120 is commercialized as a unit by a chip manufacturer (e.g., the manufacturer of the LDO circuit 108). In other examples, different components of the circuit 120 (e.g., the battery 102, the switching converter 104, the microcontroller 106, and/or the LDO circuit 108) are sold separately and are combined on the PCB 122 by a third-party according to target criteria for powering a particular load.

Figure 2A:
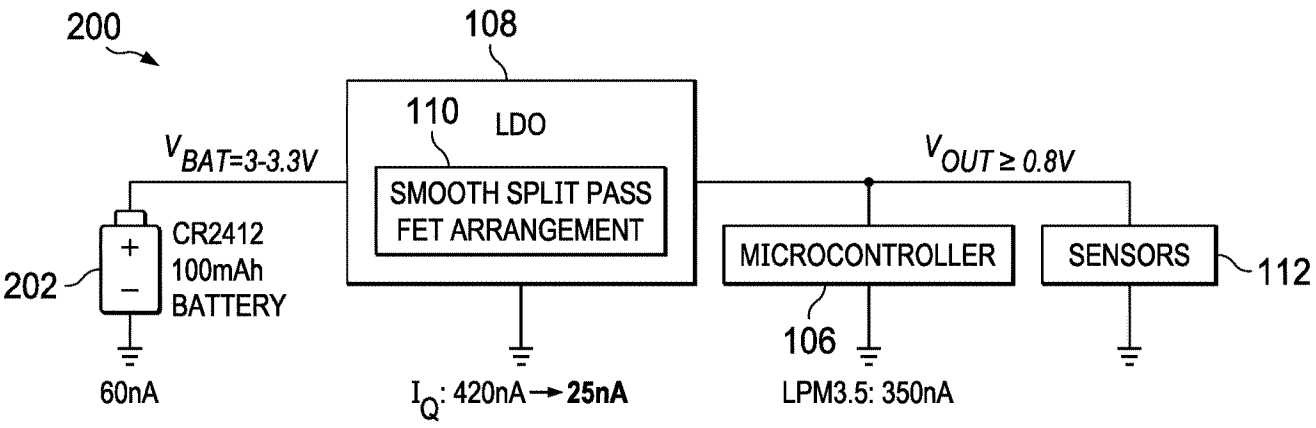
FIG. 2A is a block diagram of another system in accordance with an example embodiment.

FIG. 2A is a block diagram of another battery-operated electronic system 200 in accordance with an example embodiment. As shown, the system 200 includes a battery 202 coupled to the LDO circuit 108 and configured to provide an input voltage (e.g., 3V-3.3V) to the LDO circuit 108. In some examples, the battery 102 corresponds to a CR2412 100 mAh battery. The output (e.g., at least 0.8V) is provided to the microcontroller 106 and the load 112. Again, the microcontroller 106 is configured to send information to and/or receive information from the load 112 (e.g., sensors). In the example of FIG. 2, the LDO circuit 108 includes the smooth spit pass FET arrangement 110 of an example embodiment, which reduces the Iq compared to other LDO circuit topologies (represented in FIG. 2A as a reduction from 420 nA to 25 nA). With the reduced Iq for the LDO circuit 108 of an example embodiment and/or other improvements (e.g., reduced power consumption of the microcontroller 106), the lifetime of the battery 202 with the system 200 is extended from approximately 8.8 years to approximately 12.7 years.

Figure 2B:
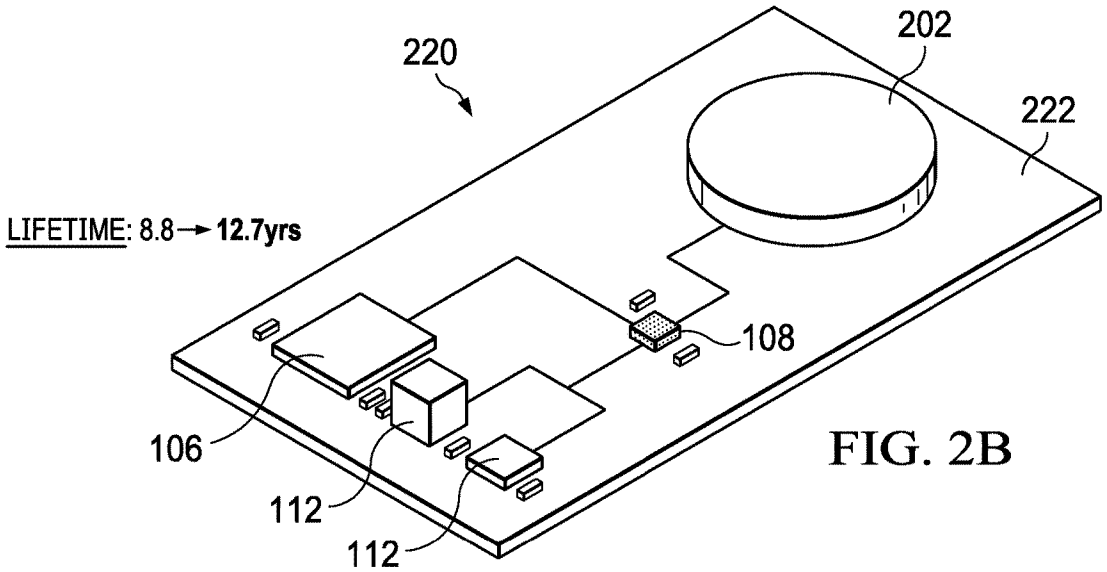
FIG. 2B is a perspective view of a circuit with the system components of FIG. 2A in accordance with an example embodiment.

FIG. 2B is a perspective view of a circuit 220 with the system components of FIG. 2A in accordance with some examples. In FIG. 2B, the circuit 220 includes a PCB 222 with the battery 202, the LDO circuit 108, the microcontroller 106, and the load 112 mounted to the PCB 222. In some examples, the circuit 220 is commercialized as a unit by a chip manufacturer (e.g., the manufacturer of the LDO circuit 108). In other examples, different components of the circuit 220 (e.g., the battery 202, the microcontroller 106, and/or the LDO circuit 108) are sold separately and are combined on the PCB 222 by a third-party according to target criteria for powering a particular load.

Figure 3:
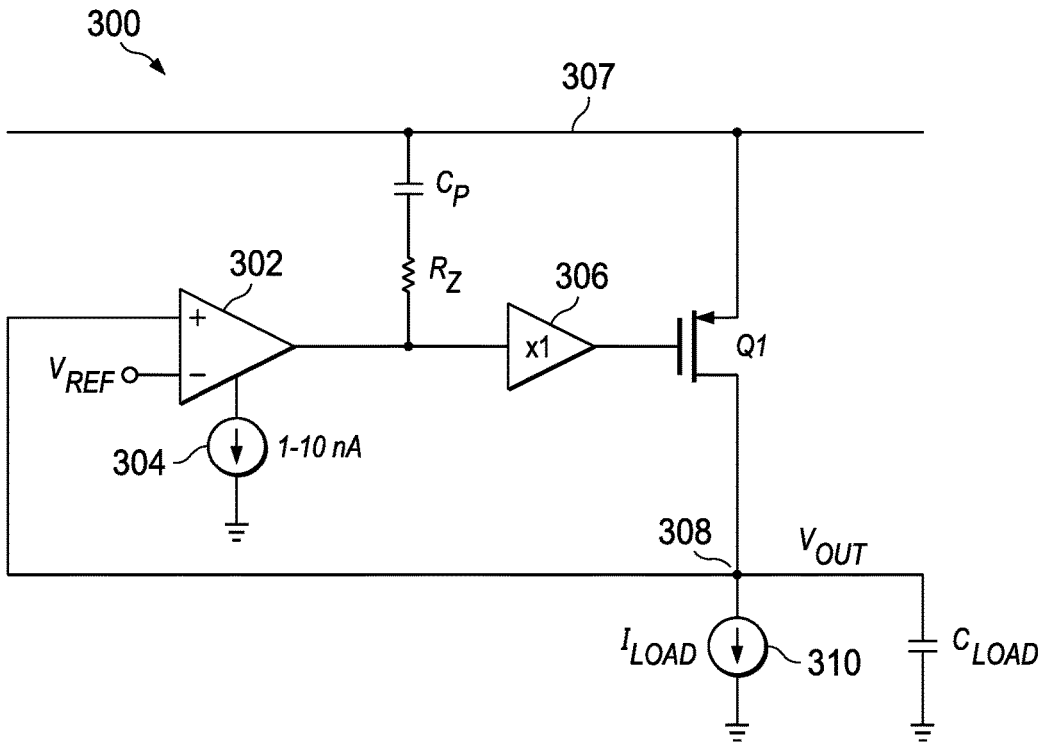
FIG. 3 (PRIOR ART)
FIG. 3 is schematic diagram of a low dropout regulation (LDO) circuit in accordance with conventional circuitry.

FIG. 3 is schematic diagram of a conventional LDO circuit. As shown, the LDO circuit 300 includes an error amplifier 302, where the output of the error amplifier 302 is used to drive a pass FET (Q1) via a buffer 306. In the example of FIG. 3, Q1 is a PMOS transistor with its source coupled to a voltage supply node 307 and its drain coupled to an output node 308. As shown, the output node 308 is coupled to a non-inverting input of the error amplifier 302 and a reference voltage is applied to the inverting input of the error amplifier 302. At the output node 308, a load is represented as a capacitor ($C_{LOAD}$) and a load current, load current ($I_{LOAD}$) source 310. In the example of FIG. 3, a capacitor ($C_P$) and a resistor ($R_Z$) are coupled in series between the voltage supply node 307 and the output of the error amplifier 302. $C_P$ and $R_Z$ correspond to a pole and a zero of the regulation loop for the LDO circuit 300. With the LDO circuit topology represented in FIG. 3, the quiescent current is larger than desired in order to stabilize the LDO control loop.

Figure 4A:
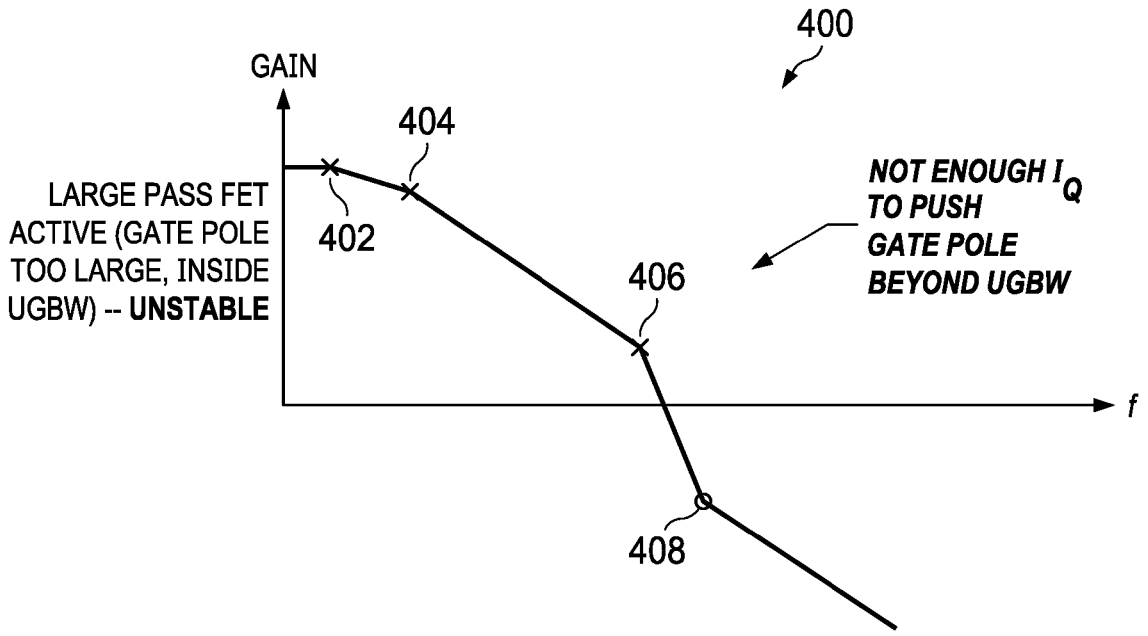
FIG. 4A (PRIOR ART)
FIG. 4A is a graph showing poles and a zero for an unstable LDO circuit in accordance with the conventional circuitry.

FIG. 4A is a graph 400 showing poles and a zero for an unstable, conventional LDO circuit as in FIG. 3 that utilizes a large pass transistor Q1. In graph 400 of FIG. 4A, poles 402, 404, and 406 and a zero 408 are represented as a function of gain and frequency. As shown, the output pole 402 (e.g., at output node 308 in FIG. 3) corresponds to a pole at low frequencies. The error amplifier pole 404 (e.g., at the output of the error amplifier 302 in FIG. 3) is at a higher frequency compared to the output pole 402. The pass FET gate pole 406 (e.g., at the gate of Q1 in FIG. 3) is at a higher frequency compared to the error amplifier pole 404. Finally, the zero 408 is at a higher frequency compared to the pass FET gate pole 406. When an LDO circuit has poles and a zero similar to what is represented in graph 400, it is indicative of a light load state (e.g., $I_{LOAD}$~8 mA) for the LDO circuit that has insufficient Iq to push the pass FET gate pole 406 beyond the unity gain bandwidth (UGBW). This is due to a large pass FET active scenario for the LDO circuit corresponding to graph 400. Accordingly, the LDO circuit scenario represented in graph 400 is unstable.

Figure 4B:
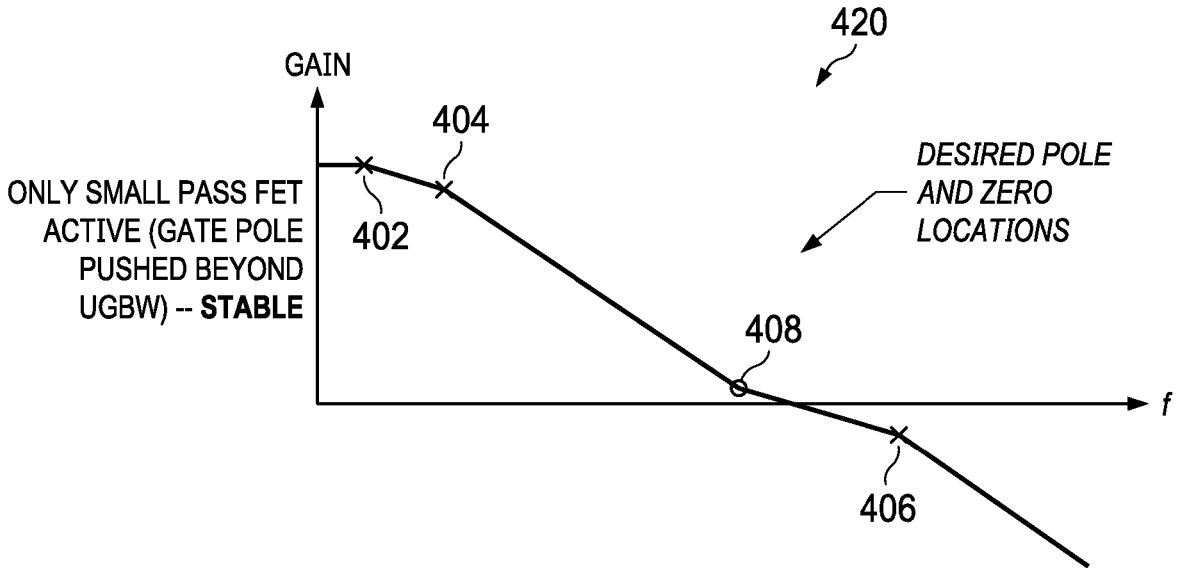
FIG. 4B is a graph showing poles and a zero for a stable LDO circuit in accordance with an example embodiment.

FIG. 4B is a graph 420 showing poles and a zero for a stable LDO circuit in accordance with an example embodiment. In graph 420 of FIG. 4B, the poles 402, 404, and 406 and the zero 408 are again represented as a function of gain and frequency. In graph 420, the pass FET gate pole 406 is pushed beyond the zero 408, which represents a stable LDO circuit scenario. When an LDO circuit has poles and a zero similar to what is represented in graph 420, an LDO circuit with a light load does not require significant Iq to push the pass FET gate pole 406 beyond the UGBW. This is due to a small pass FET active scenario for the LDO circuit corresponding to graph 420. Accordingly, the LDO circuit scenario represented in graph 420 is stable.

Figure 5:
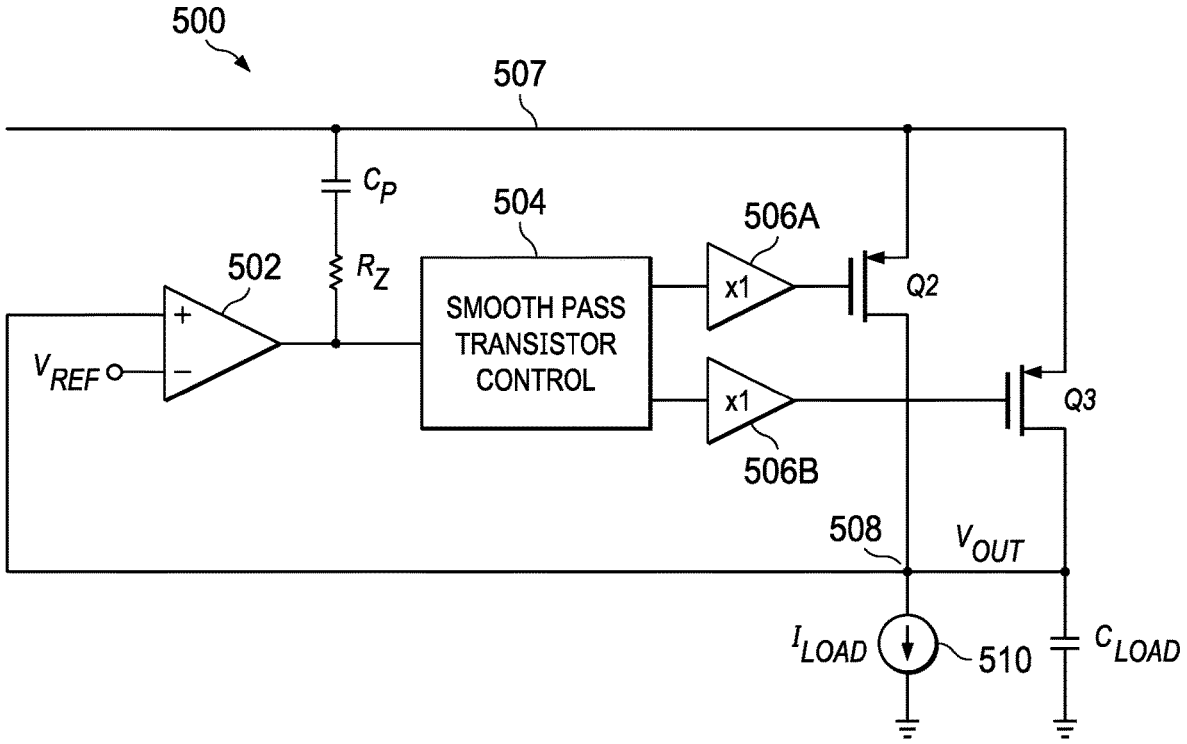
FIG. 5 is a diagram of an LDO circuit in accordance with an example embodiment.

FIG. 5 is a diagram of an LDO circuit 500 (an example of the LDO circuit 108 in FIGS. 1A, 1B, 2A, 2B) in accordance with some examples. In FIG. 5, the LDO circuit 500 includes an error amplifier 508, where the output of the error amplifier 508 is used to drive partitioned pass FETs (Q2 and Q3) via respective buffers 506A and 506B. More specifically, the LDO circuit 500 uses a smooth pass FET control circuit 504 at the output of the error amplifier 502 to drive Q2 and Q3 via the respective buffers 506A and 506B. In different examples, the number of pass FETs varies and/or the topology of the smooth pass FET control circuit 504 varies. In the example of FIG. 5, Q2 is a PMOS transistor that includes a source coupled to a voltage supply node 507 and a drain coupled to an output node 508. Also, Q3 is a PMOS transistor that includes a source coupled to the voltage supply node 507 and terminal a drain coupled to the output node 508. As shown, the output node 508 is coupled to the non-inverting input of the error amplifier 502. At the output node 508, a load is represented as $C_{LOAD}$ and a load current, $I_{LOAD}$ source 510. In the example of FIG. 5, $C_P$ and $R_Z$ are coupled in series between the voltage supply node 507 and the output of the error amplifier 502, where $C_P$ and $R_Z$ correspond to a pole and a zero of the regulation loop for the LDO circuit 500. With the LDO circuit 500 represented in FIG. 5, Iq is reduced compared to the topology represented in FIG. 3, and stability at a no load state is improved.

Figure 6:
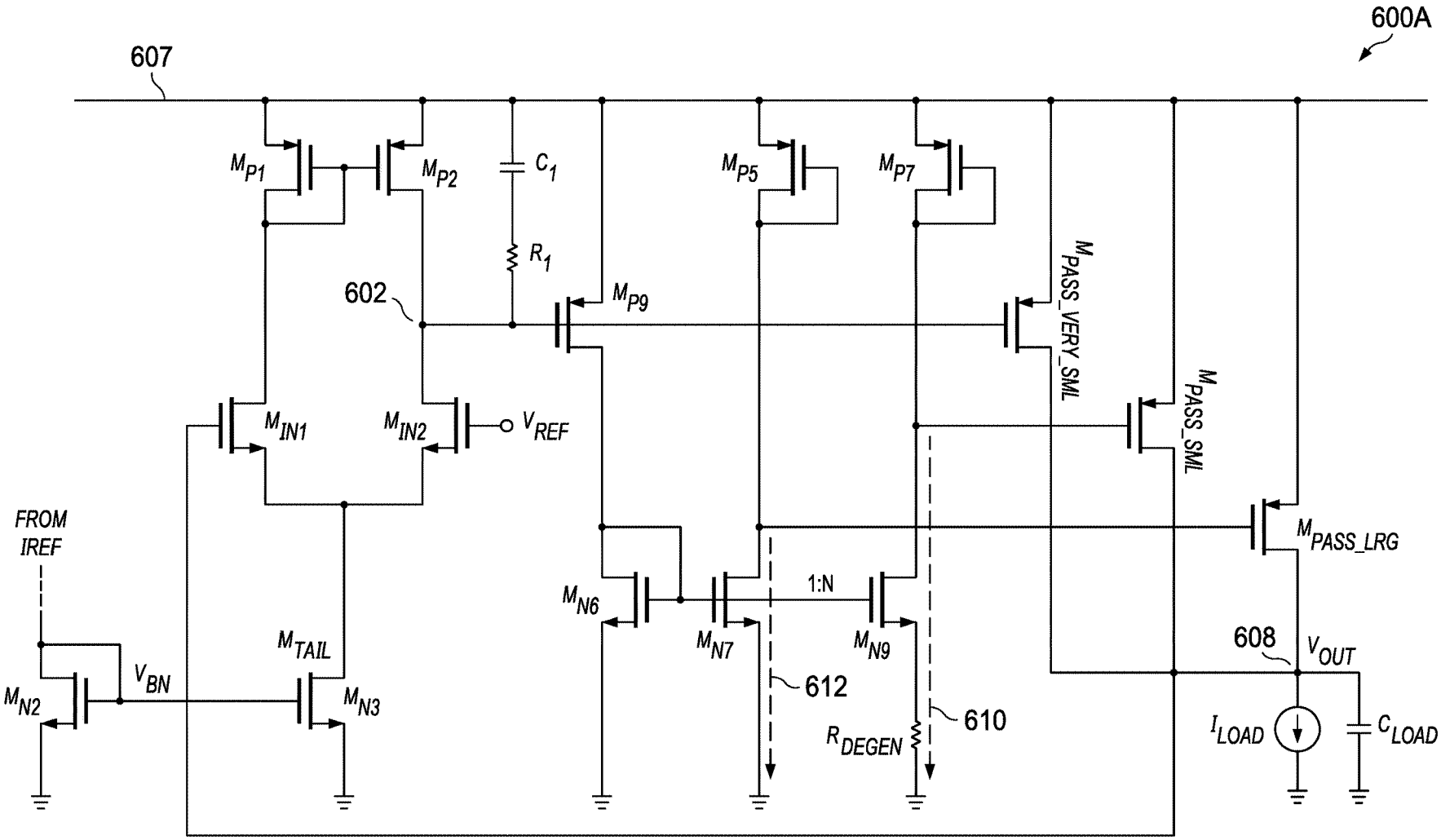
FIG. 6 is a schematic diagram of an LDO circuit in accordance with an example embodiment.

FIG. 6 is a schematic diagram of an LDO circuit 600 (an example of the LDO circuit 108 in FIGS. 1A, 1B, 2A, and 2B, or the LDO circuit 500 in FIG. 5) in accordance with some examples. As shown, the LDO circuit 600 includes an voltage supply node 607 and an output node 608. Between the voltage supply node 607 and the output node 608, various components are used to regulate $V_{OUT}$ at the output node 608 as a function of load current, which varies over time. In the example of FIG. 6, the LDO circuit 600 includes error amplifier components (e.g., $M_{P1}$, $M_{P2}$, $M_{IN1}$, $M_{IN2}$ in FIG. 6, which correspond to example components of the error amplifier 502 in FIG. 5), where node 602 corresponds to an output node of a first stage of the error amplifier. The LDO circuit 600 also includes smooth split pass FET arrangement components (e.g., $M_{PASS_VERY_SML}$, $M_{PASS_SML}$, and $M_{PASS_LRG}$, $M_{N7}$, $M_{N9}$, $R_{DEGEN}$ in FIG. 6, which corresponds to example components of the smooth pass FET control arrangement 110 in FIG. 1). Example components of a smooth split pass FET arrangement include pass transistors (e.g., $M_{PASS_VERY_SML}$, $M_{PASS_SML}$, and $M_{PASS_LRG}$ in FIG. 6) and components of a smooth pass transistor control circuit (e.g., $M_{N7}$, $M_{N9}$, and $R_{DEGEN}$ in FIG. 6, which corresponds to example components of the smooth pass transistor control circuit 504 in FIG. 5). Other components of the LDO circuit 600 include various NMOS transistors ($M_{N3}$ and $M_{N6}$) and PMOS transistors ($M_{P9}$, $M_{P5}$ and $M_{P7}$) in the arrangement shown, and a capacitor (C1) and resistor (R1) coupled between the voltage supply node 607 and the node 602.

In the example of FIG. 6, a triple partitioned pass FET scheme is achieved in a continuous manner with no hard switching of FETs on and off. The smallest FET ($M_{PASS_VERY_SML}$) is a LVT PMOS driven directly by the error amplifier OTA output. At light loads (e.g., under ~8 mA), the small FET ($M_{PASS_SML}$) dominates current delivery to $V_{OUT}$. This means that the error amplifier sees a gate pole based on the gate capacitance of the small FET, which is ~10 times smaller than the large FET. At heavy loads, the large FET ($M_{PASS_LRG}$) dominates the current delivery to $V_{OUT}$. However, since more current is used to bias the large FET gate at heavy load, the gate pole is at higher frequencies and does not impact the stability of the LDO circuit 600. The load current crossover point between the small and large FET being dominant is set by the sizing ratio of $M_{N7}$ and $M_{N9}$ divided by $R_{DEGEN}$ as well as the ratio of $M_{P5}$ to $M_{PASS_LRG}$ and $M_{P7}$ to $M_{PASS_SML}$.

In some examples, the error amplifier comprises a first stage (e.g., $M_{P1}$, $M_{P2}$, $M_{IN1}$, $M_{IN2}$ in FIG. 6) and wherein a control terminal of the third pass transistor ($M_{PASS_VERY_SML}$) is coupled to an output (e.g., node 602 in FIG. 6) of the first stage. In some examples, the control circuit comprises a first current path (e.g., the current path 610 in FIG. 6) coupled to a control terminal (such as a gate of a MOS transistor or a base of bipolar transistor) of the second pass transistor ($M_{PASS_SML}$), wherein the output of the first stage triggers current flow along the first current path, and wherein the first current path includes a resistor (e.g., $R_{DEGEN}$ in FIG. 6) configured to increase a voltage level at the control terminal of the second pass transistor as the load current increases. In some examples, the control circuit comprises a second current path (e.g., the current path 612 in FIG. 6) coupled to a control terminal of the first pass transistor ($M_{PASS_LRG}$), wherein the output of the first stage triggers current flow along the second current path. In some examples, the first pass transistor is at least an order of magnitude larger than the second pass transistor, and the second pass transistor is at least an order of magnitude larger than the third pass transistor. The sizes of $M_{PASS_VERY_SML}$, $M_{PASS_SML}$, and $M_{PASS_LRG}$ may vary, where the selected parameters for channel width (W), channel length (L), W/L, W*L, or parasitic capacitance are based on targets for maximum load current (e.g., 50 mA-200 mA), voltage dropout (e.g., 200 mV-400 mV), and supply voltage range (e.g., 2-4V). To select the sizes of the pass transistors, a maximum load current (e.g., 50 mA-200 mA) may be used to select a size of the first (largest) pass transistor. Meanwhile, the size of the second (small) pass transistor and the third (very small) pass transistor are selected for stability at light loads.

In operation, the value at node 602 is a function of $V_{OUT}$ (provided to the gate of $M_{IN1}$) and $V_{REF}$ (provided to the gate of $M_{IN2}$). If $V_{OUT}$ drops due to an increase in load current ($I_{LOAD}$ herein) at the output node 608, the voltage at node 602 will increase, resulting in current flow through $M_{PASS_VERY_SML}$, $M_{PASS_SML}$, and $M_{PASS_LRG}$ (the node 602 is coupled to the gate of $M_{PASS_VERY_SML}$ and also triggers current flow through $M_{N6}$, $M_{N7}$, and $M_{N9}$) to maintain $V_{OUT}$ above a target level, where $M_{PASS_VERY_SML}$ dominates at low $I_{LOAD}$ values. If $I_{LOAD}$ continues to ramp up, $V_{OUT}$ will drop again, resulting in increased current flow through $M_{PASS_VERY_SML}$, $M_{PASS_SML}$, and $M_{PASS_LRG}$ to maintain $V_{OUT}$ above a target level, where $M_{PASS_SML}$ dominates at mid $I_{LOAD}$ values. If $I_{LOAD}$ continues to ramp up, $V_{OUT}$ will drop again, resulting in increased current flow through $M_{PASS_VERY_SML}$, $M_{PASS_SML}$, and $M_{PASS_LRG}$ to maintain $V_{OUT}$ above a target level, where $M_{PASS_LRG}$ dominates at higher $I_{LOAD}$ values. If $I_{LOAD}$ continues to ramp up, $V_{OUT}$ will drop again, resulting in increased current flow through $M_{PASS_VERY_SML}$, $M_{PASS_SML}$, and $M_{PASS_LRG}$ to maintain $V_{OUT}$ above a target level.

Figure 7:
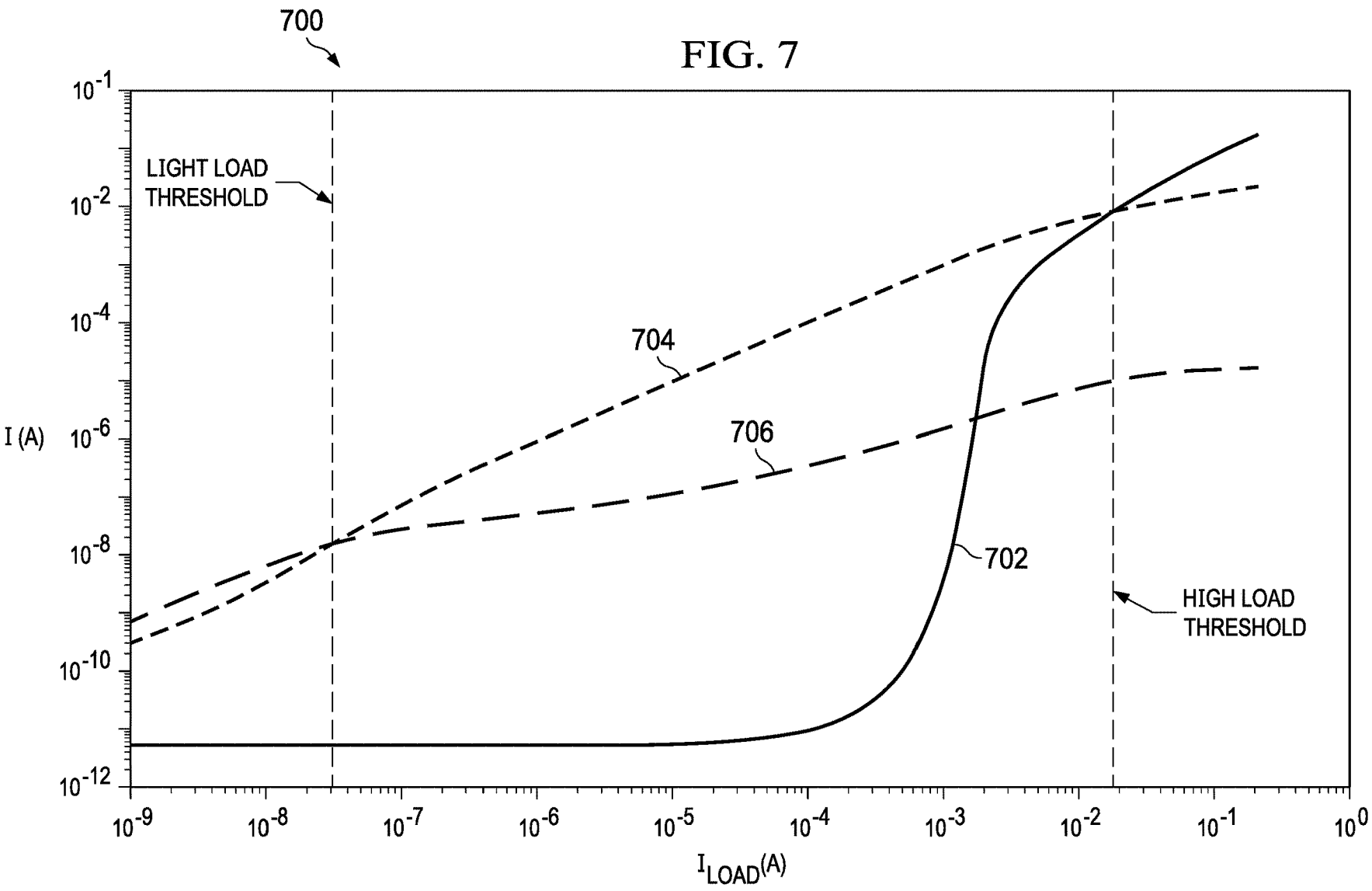
FIG. 7 is a graph showing load current through different pass field-effect transistors (FETs) of an LDO circuit in accordance with an example embodiment.

FIG. 7 is a graph 700 showing pass current (vertical axis) as function of $I_{LOAD}$ (horizontal axis) for different pass FETs. More specifically, the curve 706 corresponds to a first continuous conduction curve representing pass current flow through a very small pass transistor (e.g., $M_{PASS_VERY_SML}$) as a function of $I_{LOAD}$, curve 704 corresponds to a second continuous conduction curve representing pass current flow through a small pass transistor (e.g., $M_{PASS_SML}$) as a function of $I_{LOAD}$, and curve 702 corresponds to a third continuous conduction curve representing pass current flow through a large pass transistor (e.g., $M_{PASS_LRG}$) as a function of $I_{LOAD}$. As shown by the curves 702, 704, and 706 in graph 700, the pass currents for $M_{PASS_VERY_SML}$, $M_{PASS_SML}$, and $M_{PASS_LRG}$ as $I_{LOAD}$ increases are continuous with each dominating a different portion of $I_{LOAD}$ values. Initially, when $I_{LOAD}$ for an LDO circuit is below a light load threshold, the pass current of the very small pass transistor dominates the pass currents of the small pass transistor and the large pass transistor as represented in the graph 700. Once $I_{LOAD}$ is above a high load threshold, the pass current of the large pass transistor dominates the pass currents of the small pass transistor and the very small pass transistor as represented in the graph 700. Between the light load threshold and the high load threshold, the pass current of the small pass transistor dominates the pass currents of the very small pass transistor and the very small pass transistor as represented in the graph 700.

In at least some examples of the proposed LDO circuit topology, triple partitioning (in other words, using three pass transistors instead of a single pass transistor) of the pass FET is achieved in a smooth continuous manner (where the sizes of the smaller pass transistors support light load stability and where the size of the largest pass transistor supports a maximum load current), which eliminates the need for complex load current sensing (that would draw a large Iq in the off state) to determine which pass FET(s) should be turned on. Moreover, eliminating the need for current sensing circuitry that switches between pass FETs will reduce the risk of toggling between FETs and hard switching effects (such as hysteresis).

In at least some examples of the proposed LDO circuit topology, the pass FET gate pole automatically moves with load current with no load current sensor required. This enables stability across load current without the need for a current sensor. In at least some examples of the proposed LDO circuit topology, the main pass FETs are split into two, a small and a large (~10 times larger). Using a sizing difference in the drivers and placing a degeneration resistor between the small FET driver and ground, at light loads, the small FET will dominate in current delivery. At heavy loads, the degeneration resistor reduces the drive ability of the small FET driver, and the large FET is able to dominate current delivery to $V_{OUT}$. Moreover, a third very small pass FET, driven by the error amplifier OTA directly, is employed to ensure that $V_{OUT}$ can be regulated if the leakage currents in the small and large FET drivers are too large to maintain control.

In some examples, a system includes a battery (e.g., the battery 102 in FIG. 1, or the battery 202 in FIG. 2). The system also includes an LDO circuit (e.g., the LDO circuit 108 in FIGS. 1A, 1B, 2A, 2B, the LDO circuit 500 in FIG. 5, or the LDO circuit 600 in FIG. 6) with an input coupled to the battery or a switching converter (e.g., the switching converter 104 in FIGS. 1A and 1B) between the battery and the LDO circuit. The system also includes a load (e.g., the load 112 in FIGS. 1A, 1B, 2A, 2B, or $C_{LOAD}$ in FIGS. 5 and 6) coupled to an output of the LDO circuit. The LDO circuit includes an error amplifier (e.g., the error amplifier 502 in FIG. 5, or related components in FIG. 6 such as $M_{P1}$, $M_{P2}$, $M_{IN1}$, $M_{IN2}$). The LDO circuit also includes a control circuit (e.g., the smooth pass transistor control circuit 504 in FIG. 5, or related components in FIG. 6 such as $M_{N7}$, $M_{N9}$, $R_{DEGEN}$) coupled to the error amplifier. The LDO circuit also includes a first pass transistor (e.g., Q3 in FIG. 5, or $M_{PASS_LRG}$ in FIG. 6) coupled to the control circuit and configured to provide a first pass current as a function of load current (e.g., $I_{LOAD}$ in FIGS. 5 and 6) according to a first continuous conduction curve (e.g., the continuous conduction curve 702 in FIG. 7). The LDO circuit also includes a second pass transistor (e.g., Q2 in FIG. 5, or $M_{PASS_SML}$ in FIG. 6) coupled to the control circuit and configured to provide a second pass current as a function of load current according to a second continuous conduction curve (e.g., the continuous conduction curve 704 in FIG. 7).

In some examples, the system includes a PCB (e.g., the PCB 122 in FIG. 1B, or the PCB 222 in FIG. 2B), where the LDO circuit and the load are components mounted on the PCB. In other examples, the LDO, control circuit, passive circuit elements, microcontroller (if used) and/or sensors (if used) are provided in a single semiconductor package (and more preferably on a single semiconductor die). In some examples, the system includes comprising a microcontroller (e.g., the microcontroller 106 in FIGS. 1A, 1B, 2A, 2B) powered by an output of the switching converter or the LDO circuit. In some examples, the second pass transistor is smaller than the first pass transistor, and wherein the second pass transistor begins providing the second pass current before the first pass transistor begins providing the first pass current as the load current increases from a no load state.

In some examples, the LDO circuit includes a third pass transistor (e.g., $M_{PASS_VERY_SML}$ in FIG. 6) configured to provide a third pass current as a function of load current according to a third continuous conduction curve (e.g., the continuous conduction curve 706 in FIG. 7), and wherein the third pass transistor is smaller than the second pass transistor, and wherein the third pass transistor begins providing the third pass current before the second pass transistor begins providing the second pass current as the load current increases from a no load state.

In some examples, the error amplifier comprises a first stage (e.g., $M_{P1}$, $M_{P2}$, $M_{IN1}$, $M_{IN2}$ in FIG. 6) and wherein a control terminal of the third pass transistor is coupled to an output (e.g., node 602 in FIG. 6) of the first stage. In some examples, the control circuit comprises a first current path (e.g., the current path 610 in FIG. 6) coupled to a control terminal (such as a gate of a MOS transistor or a base of bipolar transistor) of the second pass transistor, wherein the output of the first stage triggers current flow along the first current path, and wherein the first current path includes a resistor (e.g., $R_{DEGEN}$ in FIG. 6) configured to increase a voltage level at the control terminal of the second pass transistor as the load current increases. In some examples, the control circuit comprises a second current path (e.g., the current path 612 in FIG. 6) coupled to a control terminal of the first pass transistor, wherein the output of the first stage triggers current flow along a second current path. In some examples, the first pass transistor is at least an order of magnitude larger than the second pass transistor (e.g., W/L or W*L for the first pass transistor is at least 10 times larger than W/L or W*L for the second pass transistor).

In some examples, an LDO integrated circuit (IC) includes an error amplifier (e.g., the error amplifier 502 in FIG. 5, or related components in FIG. 6 such as $M_{P1}$, $M_{P2}$, $M_{IN1}$, $M_{IN2}$) and a control circuit (e.g., the smooth pass transistor control circuit 504 in FIG. 5, or related components in FIG. 6 such as $M_{N7}$, $M_{N9}$, $R_{DEGEN}$) coupled to the error amplifier. The LDO IC also includes a first pass transistor (e.g., Q3 in FIG. 5, or $M_{PASS_LRG}$ in FIG. 6) coupled to the control circuit and configured to provide a first pass current as a function of load current (e.g., $I_{LOAD}$ in FIGS. 5 and 6) according to a first continuous conduction curve (e.g., the continuous conduction curve 702 in FIG. 7). The LDO circuit also includes a second pass transistor (e.g., Q2 in FIG. 5, or $M_{PASS_SML}$ in FIG. 6) coupled to the control circuit and configured to provide a second pass current as a function of load current according to a second continuous conduction curve (e.g., the continuous conduction curve 704 in FIG. 7). In some examples, the second pass transistor is smaller than the first pass transistor, and wherein the second pass transistor begins providing the second pass current before the first pass transistor begins providing the first pass current as the load current increases from a no load state. In some examples, the LDO IC also includes a third pass transistor (e.g., $M_{PASS_VERY_SML}$ in FIG. 6) configured to provide a third pass current as a function of load current according to a third continuous conduction curve (e.g., the continuous conduction curve 706 in FIG. 7), wherein the third pass transistor is smaller than the second pass transistor, and wherein the third transistor begins providing the third pass current before the second pass transistor being providing the second pass current as the load current increases from a no load state.

In some examples, an LDO circuit includes a voltage supply node (e.g., node 507 in FIG. 5, or node 607 in FIG. 6). The LDO circuit also includes an output node (e.g., node 508 in FIG. 5, or the node 608 in FIG. 6). The LDO circuit also includes an error amplifier (e.g., the error amplifier 502 in FIG. 5, or related components in FIG. 6 such as $M_{P1}$, $M_{P2}$, $M_{IN1}$, $M_{IN2}$) coupled to the voltage supply node and the output node, wherein the error amplifier includes a first stage (e.g., $M_{P1}$, $M_{P2}$, $M_{IN1}$, $M_{IN2}$ in FIG. 6). In some examples, the LDO circuit includes a control circuit (e.g., the smooth pass transistor control circuit 504 in FIG. 5, or related components in FIG. 6 such as $M_{N7}$, $M_{N9}$, $R_{DEGEN}$) with a first current path (e.g., the current path 610 in FIG. 6) coupled to an output (e.g., node 602 in FIG. 6) of the first stage, and with a second current path (e.g., the current path 612 in FIG. 6) coupled to the output of the first stage. The LDO circuit also includes a first pass transistor (e.g., Q3 in FIG. 5, or $M_{PASS_LRG}$ in FIG. 6) with a first current terminal coupled to the voltage supply node, with a second current terminal coupled to the output node, and with a control terminal coupled to the second current path. The LDO circuit also includes a second pass transistor (e.g., Q2 in FIG. 5, or $M_{PASS_SML}$ in FIG. 6) with a first current terminal coupled to the voltage supply node, with a second current terminal coupled to the output node; and with a control terminal coupled to the first current path.

In some examples, the first pass transistor is configured to provide a first pass current as a function of load current (e.g., $I_{LOAD}$ in FIGS. 5 and 6) at the output node according to a first continuous conduction curve (e.g., the continuous conduction curve 702 in FIG. 7), and wherein the second pass transistor is configured to provide a second pass current as a function of load current at the output node according to a second continuous conduction curve (e.g., the continuous conduction curve 704 in FIG. 7). In some examples, the second pass transistor is smaller than the first pass transistor, and wherein the second pass transistor begins providing the second pass current before the first pass transistor begins providing the first pass current as the load current increases from a no load state.

In some examples, the LDO circuit also includes a third pass transistor (e.g., $M_{PASS_VERY_SML}$ in FIG. 6) with a first current terminal coupled to the voltage supply node, with a second current terminal coupled to the output node, and with a control terminal coupled to the output of the first stage. In some examples, the third pass transistor is smaller than the second pass transistor, and wherein the third transistor begins providing the third pass current before the second pass transistor being providing the second pass current as the load current increases from a no load state. In some examples, the first pass transistor is at least an order of magnitude larger than the second pass transistor, and the second pass transistor is at least an order of magnitude larger than the third pass transistor.

While the above description of the example embodiments refer to MOS transistors, bipolar transistors (such as NPN or PNP) may be used instead. Furthermore, with some modification to the example embodiments, one of ordinary skill in the art can interchangeably use NMOS and PMOS transistors to implement the example embodiments. Also, in other examples, the load comprises an electronic circuit with a predetermined voltage rating and current rating supported by an LDO with a smooth split pass arrangement as described herein.

Certain terms have been used throughout this description and claims to refer to particular system components. As one skilled in the art will appreciate, different parties may refer to a component by different names. This document does not intend to distinguish between components that differ only in name but not in their respective functions or structures. In this disclosure and claims, the terms "including" and "comprising" are used in an open-ended fashion, and thus should be interpreted to mean "including, but not limited to . . . ."

The term "couple" is used throughout the specification. The term may cover connections, communications, or signal paths that enable a functional relationship consistent with the description of the present disclosure. For example, if device A generates a signal to control device B to perform an action, in a first example device A is coupled to device B by direct connection, or in a second example device A is coupled to device B through intervening component C if intervening component C does not alter the functional relationship between device A and device B such that device B is controlled by device A via the control signal generated by device A.

The above discussion is meant to be illustrative of the principles and various embodiments of the present invention. Numerous variations and modifications will become apparent to those skilled in the art once the above disclosure is fully appreciated.

What is claimed is:

1. A system, comprising:

a low dropout regulator (LDO) circuit with an input adapted to be coupled to a battery and an output adapted to be coupled to a load; and wherein the LDO circuit comprises:

an error amplifier;

a control circuit coupled to the error amplifier;

a first pass transistor coupled to the control circuit and configured to provide a first pass current as a function of a load current according to a first continuous conduction curve;

a second pass transistor coupled to the control circuit and configured to provide a second pass current as a function of the load current according to a second continuous conduction curve; and a third pass transistor configured to provide a third pass current as a function of the load current according to a third continuous conduction curve, wherein the third pass transistor is smaller than the second pass transistor, and wherein the third pass current is greater than the first pass current and the second pass current below a light load threshold.

2. The system of claim 1, wherein the first pass current is greater than the second pass current once the load current is greater than a high load threshold.

3. The system of claim 2, wherein the second pass transistor is smaller than the first pass transistor, and wherein the second pass current is greater than the first pass current below the high load threshold.

4. The system of claim 1, further comprising a microcontroller powered by the output of the LDO circuit.

5. The system of claim 1, wherein the error amplifier comprises a first stage and wherein a control terminal of the third pass transistor is coupled to an output of the first stage.

6. The system of claim 5, wherein the control circuit comprises a first current path coupled to a control terminal of the second pass transistor, wherein the output of the first stage triggers current flow along the first current path, and wherein the first current path includes a resistor configured to increase a voltage level at the control terminal of the second pass transistor as the load current increases.

7. The system of claim 6, wherein the control circuit comprises a second current path coupled to a control terminal of the first pass transistor, wherein the output of the first stage triggers current flow along a second current path.

8. The system of claim 1, wherein the second pass current is greater than the first pass current and the third pass current between the light load threshold and the high load threshold.

9. A low dropout regulator (LDO) integrated circuit (IC), comprising:

an error amplifier;

a control circuit coupled to the error amplifier;

a first pass transistor coupled to the control circuit and configured to provide a first pass current as a function of a load current according to a first continuous conduction curve;

a second pass transistor coupled to the control circuit and configured to provide a second pass current as a function of the load current according to a second continuous conduction curve; and a third pass transistor configured to provide a third pass current as a function of the load current according to a third continuous conduction curve, wherein the third pass transistor is smaller than the second pass transistor, and wherein the third pass current is greater than the second pass current and the first pass current below a light load threshold.

10. The LDO IC of claim 9, wherein the second pass transistor is smaller than the first pass transistor, and wherein the second pass current is greater than the first pass current below a high load threshold.

11. The LDO IC of claim 9, wherein the error amplifier comprises a first stage and wherein a control terminal of the third pass transistor is coupled to an output of the first stage.

12. The LDO IC of claim 11, wherein the control circuit comprises a first current path coupled to a control terminal of the second pass transistor, wherein the output of the first stage triggers current flow along the first current path, and wherein the first current path includes a resistor configured to increase a voltage level at the control terminal of the second pass transistor as the load current increases.

13. The LDO IC of claim 12, wherein the control circuit comprises a second current path coupled to a control terminal of the first pass transistor, wherein the output of the first stage triggers current flow along a second current path.

14. The LDO IC of claim 9, wherein the second pass current is greater than the first pass current and the third pass current between the light load threshold and the high load threshold.

15. A low dropout regulator (LDO) circuit, comprising:

a voltage supply node;

an output node;

an error amplifier connected to the voltage supply node and the output node, wherein the error amplifier includes a first stage;

a control circuit with a first current path coupled to an output of the first stage; and with a second current path coupled to the output of the first stage, the control circuit including a resistor in the first current path;

a first pass transistor with a first current terminal coupled to the voltage supply node, with a second current terminal coupled to the output node, and with a control terminal coupled to the second current path;

a second pass transistor with a first current terminal coupled to the voltage supply node, with a second current terminal coupled to the output node; and with a control terminal coupled to the first current path.

16. The LDO circuit of claim 15, wherein the first pass transistor is configured to provide a first pass current as a function of load current at the output node according to a first continuous conduction curve, and wherein the second pass transistor is configured to provide a second pass current as a function of load current at the output node according to a second continuous conduction curve.

17. The LDO circuit of claim 16, wherein the second pass transistor is smaller than the first pass transistor, and wherein the second pass transistor begins providing the second pass current before the first pass transistor begins providing the first pass current as the load current increases from a no load state.

18. The LDO circuit of claim 15, further comprising a third pass transistor with a first current terminal coupled to the voltage supply node, with a second current terminal coupled to the output node, and with a control terminal coupled to the output of the first stage.

19. The LDO circuit of claim 18, wherein the third pass transistor is smaller than the second pass transistor, and wherein the third transistor begins providing the third pass current before the second pass transistor being providing the second pass current as the load current increases from a no load state.

20. The LDO circuit of claim 19, wherein the first pass transistor is at least an order of magnitude larger than the second pass transistor with regard to W/L or W*L, and wherein the second pass transistor is at least an order of magnitude larger than the third pass transistor with regard to W/L or W*L, where W is channel width and L is channel length.

* * * * *